United States Patent [19]

Carmichael et al.

[11] Patent Number: 4,877,043

[45] Date of Patent: Oct. 31, 1989

[54] INTERNAL COMBUSTION ENGINE SCRUBBER

[76] Inventors: Maurice Carmichael, 23920 Anza Ave., Apt. 241, Torrance, Calif. 90505; Janis Binatena, 4110 Lenora, Torrance, Calif. 90503

[21] Appl. No.: 191,395

[22] Filed: May 9, 1988

Related U.S. Application Data

[63] Continuation-in-part of Ser. No. 28,546, Mar. 20, 1987, abandoned.

[51] Int. Cl.[4] ..... B08B 3/08

[52] U.S. Cl. ..... 134/57 R; 123/198 A; 134/111; 134/113; 134/169 A

[58] Field of Search ..... 134/57 R, 109, 110, 134/111, 113, 168 R, 169 R, 169 A; 123/198 A; 210/103, 106; 68/18 F

[56] References Cited

U.S. PATENT DOCUMENTS

| | | | |
|---|---|---|---|
| 2,201,774 | 5/1940 | Hofele | 134/168 R X |
| 2,525,978 | 10/1950 | Vallerie | 134/168 R X |
| 3,779,213 | 12/1973 | Knudsen | 123/198 A X |
| 4,059,123 | 11/1977 | Bartos et al. | 134/169 A X |
| 4,082,565 | 4/1978 | Sjolander | 134/169 A X |
| 4,127,160 | 11/1978 | Joffe | 134/169 A X |
| 4,197,140 | 4/1980 | Swan | 123/198 A X |
| 4,520,773 | 6/1985 | Koslow | 134/169 A X |
| 4,578,186 | 3/1986 | Morin | 210/106 X |
| 4,606,311 | 8/1986 | Reyes et al. | 134/169 A X |
| 4,671,230 | 6/1987 | Turnipseed | 134/169 A X |

FOREIGN PATENT DOCUMENTS

| | | | |
|---|---|---|---|
| 979672 | 12/1982 | U.S.S.R. | 123/198 A |

*Primary Examiner*—Harvey C. Hornsby
*Assistant Examiner*—Stephen F. Gerrity
*Attorney, Agent, or Firm*—John E. Halamka

[57] ABSTRACT

An improved apparatus for cleaning internal combustion engines by providing a cart with wheels to transport the apparatus to the engine to the serviced. The apparatus can contain a battery or be connected to the power supply of the engine. A cleaning solution is poured into the reservoir of the apparatus. A pump delivers the cleaning solution to the input junction of the fuel supply line of the engine. Control switches insure the apparatus is started and brought up to operating pressure. If internal pressure is not achieved or if pressure is lost during operating, the power to the pump is interrupted. A return line is provided to establish a pathway for excess cleaning solution to be returned to the reservoir of the apparatus. The return line incorporates an adjustable pressure regulator to compensate for an inadequate or manufactioning engine fuel pressure regulator.

16 Claims, 2 Drawing Sheets

INTERNAL COMBUSTION ENGINE SCRUBBER

BACKGROUND OF THE INVENTION

1. Field of the Invention

This invention is a Continuation-In-Part of application Ser. No. 07/028,546, filed March 20, 1987 by the same inventors and relates to the engine cleaning art and, more particularly, to an improved apparatus which may be used to clean the combustion chamber of engines having a carburetion system or a fuel injection system.

2. Description of the Prior Art

The modern history of engines is replete with proposed solutions to the problem of removal of deposits within the operational subsystems of engines without first dismantling the engine.

U.S. Pat. No. 2,201,774 describes an apparatus for removing carbon and other deposits form internal combustion engines. However, in preparation for use of the apparatus, the engine carburetor and spark plugs must be removed before the cleaning solution can be circulated within the engine. Further, the engine cannot be run during the cleaning process.

U.S. Pat. No. 4,082,565 describes an apparatus for the removal of deposits from a fuel injection valve. However, the injection valve must be removed from the engine and installed in the apparatus.

U.S. Pat. No. 4,197,140 describes a process for cleaning internal combustion engine cylinders by manually disconnecting one-half of the spark plugs, starting the engine and then manually pouring in a cleaning solvent mixture into the carburetor. This procedure is then repeated for the other half of the engine. Because the cleaning solution is manually poured into the engine, this procedure does not control the time of exposure of the internal parts of the engine to the cleaning solution.

U.S. Pat. No. 4,520,773 describes an apparatus for the removal of deposits from an engine incorporating fuel injectors. However, the attachment of the apparatus bypasses the fuel return subsystem by inserting a plug into the fuel return line. If the fuel pressure regulator of the engine is inoperable or operating at an inadequate pressure, the apparatus in rendered useless in cleaning the engine. The engine fuel pressure regulator must first be removed and cleaned or replaced before remounting on the engine.

The following United States patents further describe various types of engine cleaning devices, none of which practices the present invention: 4,059,123, 4,606,311, 4,127,160, 4,671,230.

Thus, there has long been a need for an apparatus to control the introduction of a cleaning solution into an engine without dismantling the engine or rendering the engine inoperable.

Further, it is desired that the cleaning be conducted while the engine is running in a configuration which approximates normal operation in order to allow as many of the engine subsystems as possible to be incorporated in the cleaning process.

Further, it is also desired that the preparation of the engine and attachment of the apparatus involve minimal labor and that the operation of the apparatus not require supervision.

Further, it is also desired that the apparatus be operable with the existing condition of the fuel injection pressure regulator incorporated in the engine's fuel distribution system.

SUMMARY OF THE INVENTION

Accordingly, it is an object of the present invention to provide an improved apparatus for the cleaning of the internal subsystems of an engine.

It is another object of the present invention to provide an improved apparatus for the control of the introduction of a cleaning solution into an engine without removing parts from the engine.

It is another object of the present invention to provide an improved apparatus that will duplicate the supply and control of the fuel distribution system.

It is another object of the present invention to provide an improved apparatus for the external regulation of the engine's fuel pressure regulation system.

It is yet another object of the present invention to provide for the introduction of a cleaning solution into an engine while the engine is running.

It is another object of the present invention to provide an apparatus that will allow the fuel distribution system to be flushed to remove particles that otherwise may become lodged in the fuel injectors during the cleaning process.

It is another object of the present invention to provide an apparatus that will allow the fuel distribution system to be flushed with pulsating pressure to remove heavy particles that otherwise may become lodged in the fuel injectors during the cleaning process.

It is yet another object of the present invention to provide for the introduction of a cleaning solution during the flushing process without the engine running.

It is yet another object of the present invention to provide an apparatus which requires minimal labor to attach to the engine and little or no supervision during the cleaning operation.

The above and other objects of the present invention are achieved, according to a preferred embodiment thereof, by providing an apparatus which pumps a mixture of cleaning solution and fuel from a reservoir into the engine fuel intake loop utilizing adjustable pressure control elements external to the engine which control the supply or return adjustable pressure of the cleaning solution.

The apparatus disclosed by the present invention may be utilized to clean engines which incorporate a carburetor or fuel injection system for mixing fuel and air. The apparatus may be used on systems which include a turbo charged air supply, and is further designed as a service tool to temporarily replace the fuel supply system on all types of internal combustion engines with a variable mixture of fuel and a special cleaning additive. This mixture is pumped from the apparatus through the engine's fuel supply system, dissolving contaminant deposits and returning them to the reservoir of the apparatus by way of a fluid control line connected from the apparatus to the engine's fuel system's normal fuel return outlet (if applicable). The suspended contaminants are then harmlessly filtered out by means of a high-volume filtration system incorporated internally in the apparatus of the present invention.

The mixture of fuel and preselected chemical cleaning additive also permeates through the engine fuel system's injection nozzles or carburetor jets and fuel passages where it dissolves and eliminates olefin and varnish deposits in these components. The mixture is then introduced to the intake and combustion chambers where it extricates soft carbon from these surfaces and is conclusively burned off in the engine's normal combustion process.

The apparatus of the present invention is not disclosed by any other fuel system cleaners in that, due to its dual regulation and multi-directional flow capability, it can virtually duplicate any known type of fuel system's pressure and flow requirements—be it carbureted, throttle body injected, electronic port injected, or mechanical port injected. The components and chemical incorporated in the unit enable it to operate efficiently with gasoline, diesel or methanol fuels.

All other internal combustion engine fuel system cleaners to date utilize a single fuel output line to the engine fuel system fuel inlet and block off the fuel system's normal fuel return line after the pressure regulator. Fuel and chemical are then pressurized into the system and the engine is allowed to operate until the system runs dry. This procedure, in effect, dissolves the olefin and varnish deposits in the fuel system but allows particles that the chemical solution cannot dissolve to go nowhere except downstream into the fuel injectors' diminutive nozzle orifices. This creates a possibility of augmenting injector blockage in constant injection system and mechanical injection systems where the contaminant levels can be inordinately high. Similarly, with electronic throttle body injection systems and electronic port injection systems, there is nearly irrefutable augmenting injector blockage. This increase of potential blockage in electronic injectors is caused by the injectors discharge orifice being minute, and, the minimal clearance between the injector's pintle and the pintle cylinder wall.

The apparatus of the present invention, in its preferred embodiment, is connected to the engine fuel system's fuel input line after the engine's fuel pump and before the engine's fuel pressure regulator. A return line from the apparatus is connected to the engine fuel system's normal excess fuel return line on the fuel tank side of the system's pressure regulator. This procedure effectively duplicates the fuel system's recirculating fuel supply. Therefore, system contaminants that are dislodged by this procedure are returned to the high-volume filtration system of the apparatus and are effectively extricated from the fuel system as opposed to being forced into the injector pintle passage ways and nozzle. Because this procedure also utilizes the engine's own fuel pressure regulator to regulate system pressure during the procedure, the possibility of over-pressurization by the operator is eliminated.

In addition to the preferred embodiment, the directional flow of the apparatus can be altered by turning the unit's control valve to its open position. In this position, the unit forms an internal bypass system, enabling the unit's output pressure to be adjusted by the operator to the desired operating pressure. This procedure may be desirable in the event that the engine's fuel system does not utilize a system pressure regulator, (i.e. some carburetors).

Cycle time is controlled by an adjustable timer. Upon completion of the operating cycle, the unit automatically shuts down and activates a warning buzzer and indicator light. In the event of a major pressure loss during the cleaning process as detected by a pressure transducer, the pumping of the cleaning solution to the engine stops and the cleaning solution pump of the unit starts operating in reverse, possibly averting a cleaning solution spill and fire. After the procedure is complete, a purge switch can be activated, thereby again reversing the unit's cleaning solution pump and removing any cleaning solution remaining from the fuel system to avoid spillage when disconnecting. After several services, the unit's filtration system may become restricted, at which time a sensor will activate an indicator light to advise the operator that it is time to change the filter.

When used in conjunction with a carburetor, that either does or does not have a fuel return line, the apparatus incorporates an adjustable pressure regulator in the cleaning solution supply line. This adjustable output pressure regulator enables the apparatus to be utilized with current designs of carburetion.

When the apparatus is used in conjunction with an engine incorporating fuel injectors, the adjustable output pressure regulator in the supply line is bypassed and the adjustable return pressure regulator in the return line is engaged.

The fuel injection system of an engine contains a fuel pressure regulation device. However, this fuel pressure regulating device may be inoperable or operating at a pressure range inadequate for the proper operation of the engine. The present invention incorporates an adjustable return pressure regulator in the cleaning solution return line which may be adjusted to provide back pressure to the injectors. This back pressure increases the total fuel system pressure to a level which permits normal operation of the engine. As the cleaning solution flows through the engine's own fuel pressure regulator during the cleaning operation, the inoperable or defectively operating engine fuel pressure regulator is cleaned and may be rendered fully operational.

BRIEF DESCRIPTION OF THE DRAWING

The above and other embodiments of the present invention may be more fully understood from the following detailed description, taken together with the accompanying drawing, wherein similar reference characters refer to similar elements throughout, and in which.

DESCRIPTION OF A PREFERRED EMBODIMENT

Figure 1:
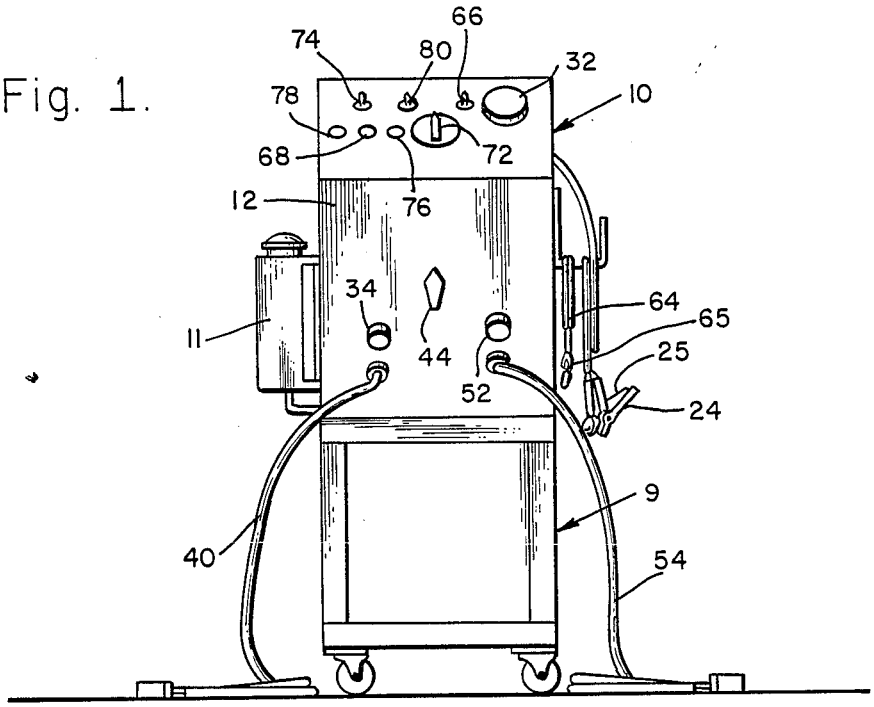
FIG. 1 is an elevational view of the present invention shown mounted on a cart.
Figure 2:
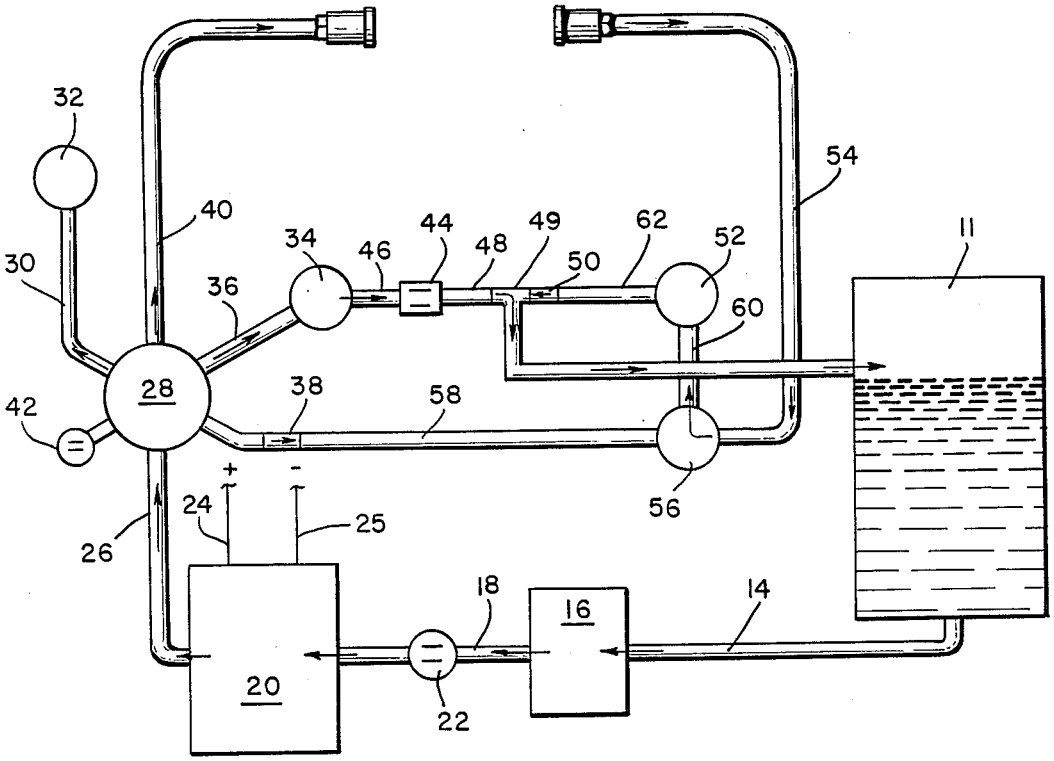
FIG. 2 is a schematic view of the apparatus of the present invention showing the flow of chemically mixed fuel where the control valve is in an open position.
Figure 3:
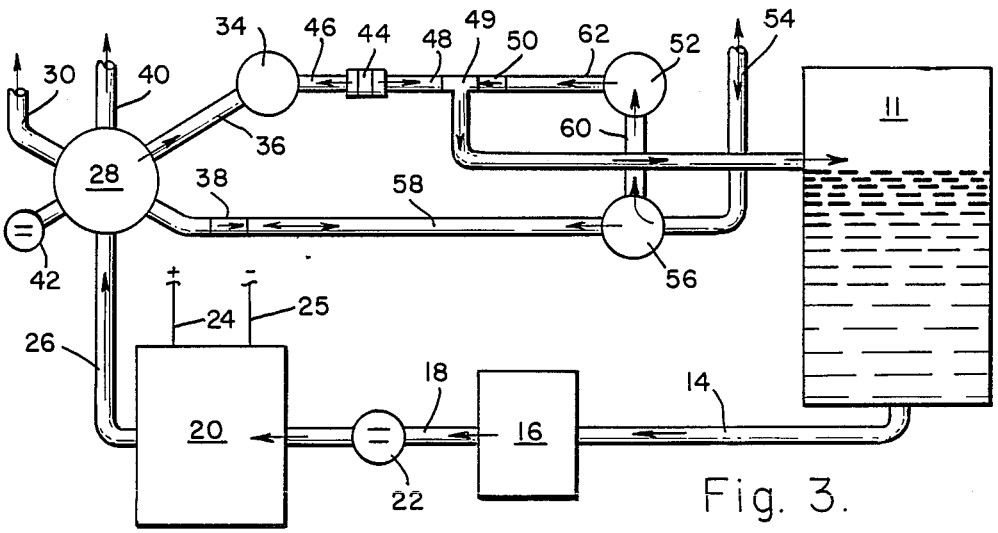
FIG. 3 is a schematic view of the apparatus of the present invention showing the flow of chemically mixed fuel when the control valve is in the closed position.

Referring now to the drawing, there is illustrated in FIG. 1 an embodiment of an engine cleaning apparatus 10 according to the principles of the present invention.

The apparatus 10 may be contained within a single portable unit including a cart 9 which may be positioned near an engine to be used to clean an internal portion of the engine. A cleaning solution reservoir 11 is mounted to the housing 12 and supplies cleaning solution via the reservoir supply line 14 through a fuel filter 16. The filter supply line 18 supplies filtered cleaning solution to a solution pump 20 mounted within the housing 12. Interposed between filter 16 and pump 20 is a filter blockage detector 22. When a blockage is detected by the filter blockage detector 22, the blockage warning indicator 79 is turned on. The solution pump 20 is an engine fuel pump selected to be capable of pumping the cleaning solution at a pressure compatible with the highest pressure required by the class of engines to be serviced by the apparatus 10.

The classes of engines may include gasoline, diesel, or methanol fueled engines.

The solution pump 20 is equipped with a positive power supply cable 24 and a negative power supply cable 25 which may be attached to a direct current power supply such as the battery of the engine to be serviced by the apparatus 10.

The pump output line 26 is attached to the output port of the solution pump 20 to the first port of the six way cleaning solution distribution body 28 as an input of fuel to the body 28. The second port of the fuel distribution body 28 is used as an output and is connected by the pressure gauge hose 30 to a pressure gage 32 mounted on housing 12. The third port of the fuel distribution body 28 is connected to the adjustable output pressure regulator 34 by the output pressure regulator hose 36. A fourth port of the fuel distribution body 28 is attached to a second one way valve 38. The one way valve allows the cleaning solution to flow into the fuel distribution body 28 during the purge cycle described below. The fifth output port of the fuel distribution body 28 is connected to the cleaning solution output line 40 of the engine cleaning apparatus 10. In the implementation of the device, this output line 40 is tinted red to color code the lines for ease of instruction and operation. The sixth output port of the fuel distribution body 28 is connected to a pressure transducer 42, a safety device described below.

The adjustable output pressure regulator 34 is connected to a control valve 44 via the control valve hose 46. The control valve 44 is open. The control valve 44 is incorporated in the engine cleaning apparatus 10 to allow the apparatus 10 to be used to clean engines without a return fuel line. When the control valve 44 is in the open position it allows the cleaning solution to return by way of the return hose 48 to the cleaning solution reservoir 11 of the apparatus 10. This open mode is available when a return path using the cleaning solution return line 54 is not utilized.

The return hose 48 is connected to one port of a three way tee 49. The second port of the tee 49 is connected to a first one-way valve 50 (note that the arrows in the drawing indicate direction of flow) to protect the return pressure regulator 52 from back pressure. The third port of the tee 49 returns the cleaning solution to the reservoir 11. A cleaning solution return line 54 returns excess from the engine cleaning solution supply system back to the cleaning solution reservoir 11 of the apparatus 10.

A cleaning solution return line 54 returns excess cleaning solution from the engine. The cleaning solution return line 54 is tinted blue for ease of instruction and operation of the engine cleaning apparatus 10. The cleaning solution return line 54 is attached to the first port of a three way fuel distribution body 56. The second port of the three way fuel distribution body 56 is attached to the second one way valve 38 via the equalizing hose 58. If the return pressure exceeds the output pressure, the excess cleaning solution passes through the second one way valve 38 into the six way fuel distribution body 28. Further, during the purge cycle described below, the equalizing hose 58 and second one way valve 38 provide a path for excess cleaning solution to be sucked from the engine cleaning apparatus 10 to avoid spillage of the cleaning solution during the disconnection of the apparatus 10 from the serviced engine.

The third port of the three way fuel distribution body 56 is connected to the adjustable return pressure regulator 52 by way of the return regulator hose 60. The output port of the adjustable return pressure regulator 52 is connected to the first one way valve 50 via the return hose 62.

The pressure transducer 42 monitors the system pressure. If the system cannot build adequate pressure because of a leak or if the system pressure is lost, the pressure transducer 42 will cause the power to the cleaning solution pump 20 to be reversed.

As a safety precaution, a ground wire 64 is attached to the apparatus 10. The ground wire 64 has an alligator clip 65 attached to the un-connected end of the ground wire 64. The alligator clip 65 is attached to the metal can used to supply fuel to the reservoir 11 to inhibit the build up of static electricity which could be discharged as a spark and ignite the flammable liquid used in the apparatus 10.

During operation of the engine cleaning apparatus 10, the fuel pump in the engine to be serviced is disconnected. The red tinted output line 40 is connected to the engine fuel line at a point after the engine fuel pump. The blue tinted return line 54 is connected to the output side of the engine's pressure regulation device. The fuel supply for the operation of the engine is then totally controlled by the apparatus 10.

Figure 4:
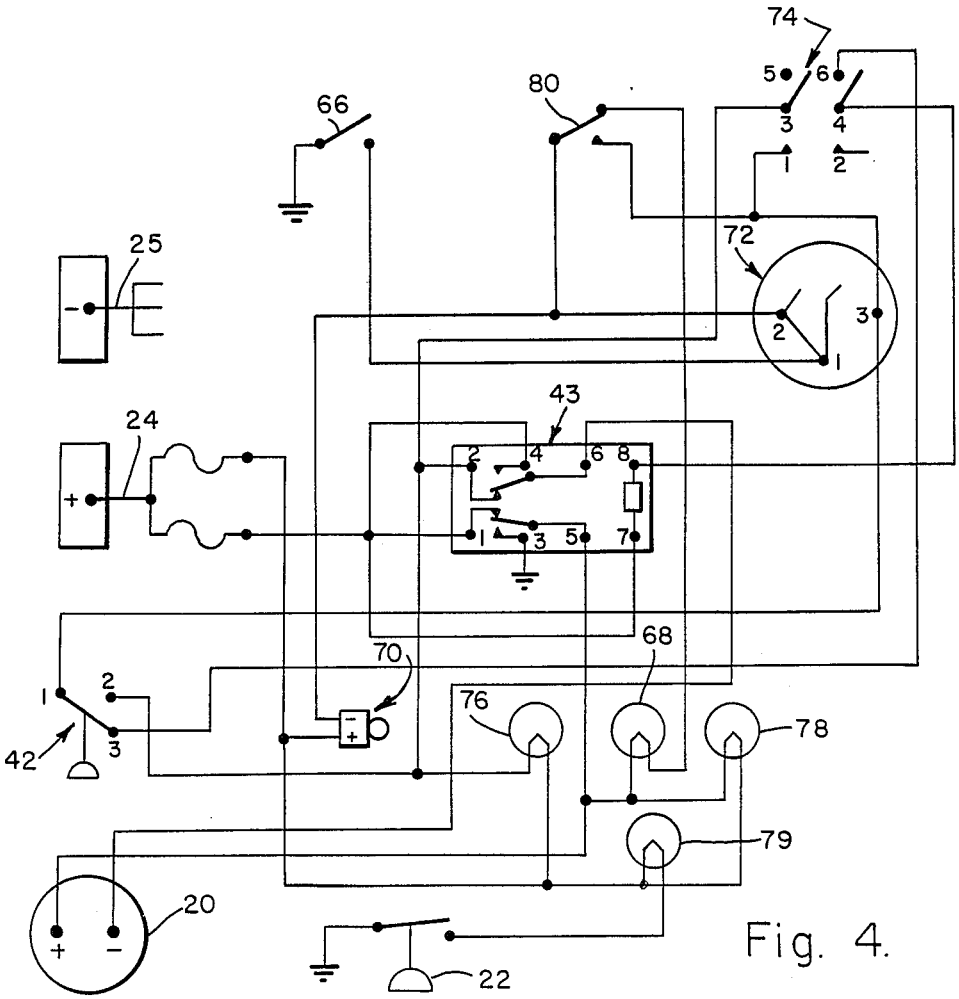
FIG. 4 is a schematic view which represents the control circuit of the apparatus of the present invention.

The control of the functioning of the engine cleaning apparatus 10 is provided by switches and relays as depicted in FIGS. 1 and 4.

Operation of the apparatus 10 is initiated by first connecting the alligator clip 65 attached to the ground wire 64 to the metal can used to fill the reservoir 11 with the cleaning solution. A preselected amount of cleaning solution such as a blend of aromatic petroleum distillate, butyl cellosolve and butox ethanol is poured into the cleaning solution reservoir 11. The power to run the apparatus 10 may be derived from the engine battery by connecting the positive wire 24 to the positive terminal of the engine's battery and the negative wire 25 to the negative terminal of the engine's battery.

The on/off switch 66 of the apparatus 10 may be placed in the on position. This will activate the amber light 68 and the warning buzzer 70. Rotating the timer switch 72 will turn off the amber light 68. Because there is zero pressure in the system, the pressure transducer 42 will apply reversed polarity power to the cleaning solution pump 20, thus operating the cleaning solution pump in reverse. When engaging the start switch 74, it will override the pressure transducer 42 and turns on the green light 76. Power is applied to the cleaning solution pump 20 and pressure in the system is allowed to build. After the threshold of the pressure transducer 42 is reached, the system will remain on and the start switch 74 may be released. Should the pressure threshold not be reached, the pressure transducer 42 would not engage and releasing the start switch 74 would stop the apparatus 10 from pumping the cleaning solution output, reverse the pump and suck back any cleaning solution into the reservoir 11. In a similar manner, should the system lose pressure, the pressure transducer 42 would detect such loss and disengage the apparatus 10 output pumping, initiate the pump suction mode, turn on the buzzer 70 and the red light 78.

The engine of the engine to be serviced may now be started and run at approximately 1500 R.P.M. for approximately fifteen minutes for gasoline engines and approximately 1100 R.P.M. for approximately thirty minutes for diesel engines. Inadequate system pressure may be experienced due to the failure of the engines pressure regulator. This failing is overcome by the apparatus 10 by adjusting the return pressure regulator 52 to attain the pressure suggested by the engine manufacturer, usually from 4 to 100 pounds per square inch.

After the time preselected by the operator on the timer switch 72 has timed out, the apparatus 10 is shut down, the buzzer 70 and the amber light 68 are activated.

The operator may now engage the purge switch 80 to activate the relay 43 from the first state of supplying direct voltage to the cleaning solution pump 20 causing the pump to pump the cleaning solution from the reservoir 11 to the output line 40 to the second state to reverse the polarity of direct current supplied to the cleaning solution pump 20. The cleaning solution pump action is reversed to suck excess cleaning solution from the internal cleaning solution distribution of the apparatus 10, the output 40 and the return cleaning solution line 54 through the equalizing hose 58 and second one way valve 38. Thus, when the apparatus 10 is disconnected from the engine, the possibility of a cleaning solution spill from the lines will be averted.

The solution supply line 40 is disconnected from the engine. The solution return line 54 is disconnected from the engine. The function of the engine fuel pump is restored.

The operation of the present invention is fully described in the following set of procedures.

Operating Procedure

1. The technician disconnects the engine fuel system's normal fuel supply line after the engine's fuel pump.
2. The technician connects the output line 40 from the apparatus 10 to the normal fuel inlet on the engine's fuel system after the engine fuel pump.
3. The technician disconnects the engine fuel system's normal fuel return line (if applicable) at the most accessible point between the engine fuel system's pressure regulation device and fuel tank.
4. The Technician connects return line 54 from the apparatus 10 to the return side of the engine fuel supply system. Connection must be made on the output side of the engine pressure regulation device so as to isolate the engine fuel system's tank from the cleaning solution system and to create a recirculating fuel system with the apparatus of the present invention.
5. The technician connects the power cables 24 and 25 from the apparatus 10 to an accessible 12 volt DC power 20 source (i.e., engine's battery).
6. The technician adds an appropriate amount of chemical additive and fuel (approximately four parts fuel to one part chemical) to mixture supply reservoir of the apparatus 10. The volume of this mixture varies according to engine size.

At this time, the cleaning process is ready to be activated. There are two different cleaning procedures that can be utilized, herein identified as Procedure "A" and Procedure "B". Procedure "A" is utilized when servicing fuel systems that are fuel injected, and incorporate a system pressure regulation device. Procedure "B" is utilized when servicing fuel systems that are carbureted and may have or have not a pressure regulation device and a fuel system return line.

Procedure "A"

1. Control valve 44 is turned to a "closed" position.
2. The unit's off/on switch is activated. This sends a negative voltage signal and activates alarm 70 and "amber" indicator light 68.
3. The adjustable cycle timer 72 is then set to approximately 15 minutes for gasoline engines and thirty minutes for diesel. This transfers negative voltage from timer terminal 2 to timer terminal 3, terminating alarm 70 and "amber" indicator 68. Through timer terminal 3, negative voltage is transferred through pressure transducer 42, which is in its rest position, to terminal 6 of "start" switch 74 which is also in its rest position, through coil terminal 8 of the pump relay 43, which in turn energizes relay 43. As the relay 43 is energized, positive voltage is transferred through relay terminals 4 and 6 to the negative terminal of the cleaning solution pump 20. Negative voltage is also transferred through relay terminals 3 and 5 to the "red" indicator light 78, which is activated, and to the cleaning solution pump positive terminal which starts the cleaning solution pump 20 operating in reverse. With the cleaning solution pump 20 operating in reverse, any remaining cleaning solution in the system is drawn out and returned to the reservoir 11 of the apparatus 10.
4.
   (a) Momentary "start" switch 74 is then activated. Negative voltage is removed from the pump relay terminal 8 and relay 43 is returned to its rest position. Positive voltage is transferred through relay terminals 1 and 5 deactivating "red" indicator light 78 and supplies positive voltage to the cleaning solution pump 20 positive terminal. Negative voltage is transferred through start switch terminals 1 and 3 to pump relay terminal 2 and the "green" indicator light 76, which is then activated. Negative voltage is transferred through relay terminals 2 and 6 to the cleaning solution pump 20 negative terminal, thus activating the cleaning solution pump 20 in its forward position. Fuel and chemical mixture is then drawn from the reservoir 11 of the apparatus 10 through the filter system 16 to the cleaning solution pump 20.
   (b) If at this time the cleaning solution filter 16 is partially restricted, the blocked filter indicating switch 22 will sense the abnormally high vacuum between the filter 16 and the cleaning solution pump 20 and send a negative signal to the "white" indicator light 79 to indicate filter blockage.
   (c) chemical mixture is then pumped from the cleaning solution pump 20 through output line 40 to the engine's fuel system. Chemical mixture continues through the engine's system's normal flow pattern until it reaches the engine fuel system's pressure regulation device. Cleaning solution pressure there builds to a point that is predetermined by the engine's fuel pressure regulation device, whereby the engine's pressure regulation device opens and chemical mixture, dissolved contaminants and loosened particles are returned to apparatus 10 by way of return line 54.
   (d) At this time, system pressure is achieved and pressure transducer 42 is activated. Negative voltage is then transferred through the pressure switch terminals 1 and 2 to relay terminal 2, thus creating a closed circuit, allowing the release of momentary "start" switch 74. The pressure transducer's purpose is to safeguard against a major leak. Similarly, if a major pressure loss occurs during the cleaning process (i.e. hose failure, poor connection) the pressure transducer 42 will revert to its rest position and send a negative voltage signal to relay coil terminal 8, thus energizing the relay 43 and immediately reversing the cleaning solution pump 20 to avoid a major cleaning solution spill.

5. Barring any leakage, the vehicle's engine is started and operates at the recommended R.P.M.. Fuel and chemical mixture thereby continue cleaning by dissolving olefin and gum deposits in the injector nozzles and further loosening softer carbon deposits on the intake and combustion surfaces, removing these deposits in the normal combustion process.
6. The technician then checks the system's operation pressure at the pressure gauge 32 on the apparatus 10 and compares it against the engine fuel system's manufacturer specifications. If the fuel system pressure is below manufacturer specified pressure, possibly indicating a binding fuel pressure regulation device on the engine's fuel system, system pressure can be compensated by adjusting the return pressure regulator 52 on the apparatus 10 to the operating pressure specified by the manufacturer. In many cases, this increase in back pressure created on the engine fuel system pressure regulation device will flush any binding contaminants from it and render the engine fuel pressure regulation device fully operational.
7. Upon completion of the cleaning process time cycle, timer 72 reverts to its rest position, thereby shutting off the cleaning solution pump 20 and activating the "amber" indicator light 68 and alarm 70 to alert the operator of cycle completion. Due to the loss in cleaning solution pressure caused by termination of the cleaning solution pump 20 of the apparatus 10, the engines operation is also ceased.
8. Momentary "purge" switch 80 is then activated. Negative voltage is thereby applied to relay terminal 8 thus energizing the relay 43. In this position, the relay again supplies negative voltage to the cleaning solution pump 20 negative terminal, thereby operating the cleaning solution pump 20 in reverse. Thus the "purge" process draws the majority of any remaining cleaning solution out of the system and returns it back to the reservoir 11 of the apparatus 10. The object of this procedure is to avoid cleaning solution spills upon disconnecting the apparatus 10 from the subject fuel system.
9. The technician at this time disconnects and removes the inlet and return lines and fittings from the engine's fuel system. He reconnects the engine fuel system's normal fuel supply and return lines. After checking for leaks, the engine is ready to operate.

Procedure "B"

1. The control valve is placed in an "open" position.
2. Same as procedure "A".
3. Same as procedure "A".
4.
   (a) Same as procedure "A".
   (b) Same as procedure "A".
   (c) Cleaning solution is pumped from the cleaning solution pump 20 through output line 40 to the engine's fuel system. Placing the gate valve 44 in its open position creates a internal bypass in the machine, whereby output the cleaning solution pressure can be adjusted by restricting bypass flow through the apparatus 10 with output pressure regulator 34.
   (d) Same as procedure "A".
5. Same as procedure "A".
6. This step is eliminated in Procedure "B".
7. Same as procedure "A".
8. Same as procedure "A".
9. Same as procedure "A".

There are two optional flushing procedures that can be utilized in the case of a severely contaminated fuel distribution system, herein identified as Procedure "C" and Procedure "D". Procedure "C" is utilized when there are particles caught within the olefin and varnish contaminants in the engine fuel distribution system which may not be removed during the normal cleaning procedure using apparatus 10. Procedure "D" is utilized when there are known heavy particle deposits caught within the olefin and varnish contaminants in the engine fuel distribution system which may not be removed during the normal cleaning procedure using apparatus 10.

Procedure "C"

1. Same as procedure "A".
2. Same as procedure "A".
3. Same as procedure "A".
4.
   (a) Same as procedure "A".
   (b) Same as procedure "A".
   (c) Same as procedure "A".
   (d) Same as procedure "A".
5. Barring any leakage, without the engine to be cleaned running, the return pressure regulator 52 of the apparatus 10 is adjusted to increase the engine system pressure to approximately 10 pounds per square inch more than the engine manufacturer's specifications. Fuel and chemical mixture thereby flow through the engine fuel distribution system and dissolve the olefin and varnish contaminants, loosening the particles that have been held in the olefin and varnish contaminants and passing them through the return line 54 of the apparatus 10 into the reservoir 11 and subsequently filtered out by the high-volume cleaning solution filter 16 of the apparatus 10, thus ensuring that the particles do not flow back into the injector nozzle.
6. Upon completion of the flushing process time cycle, the technician releases the extreme pressure of the fuel supply system of the engine to be cleaned by adjusting the pressure regulator 52 of the apparatus 10 to the engine manufacturer's specification using the pressure gauge of the apparatus 10.
7. Without disconnecting the apparatus 10 from the engine, the engine is started and operates at the recommended R.P.M. Fuel and chemical mixture thereby continue cleaning by dissolving olefin and varnish deposits in the injector nozzles and continuing on into the combustion chamber and further loosening softer carbon deposit on the intake and combustion surfaces, removing these deposits in the normal combustion process.
8. Same as procedure "A 7".
9. Same as procedure "A 8".
10. Same as procedure "A 9".

Procedure "D"

1. Same as procedure "A".
2. Same as procedure "A".
3. Same as procedure "A".
4.
   (a) Same as Procedure "A".
   (b) Same as Procedure "A".
   (c) Same as Procedure "A".
   (d) Same as Procedure "A".
5. Barring any leakage, without the engine to be cleaned running, the return pressure regulator 52 of the apparatus 10 is adjusted to increase the engine system pressure to approximately 10 pounds per square inch more than the engine manufacturer's specifications. The technician quickly opens the control valve 44 of the apparatus 10 allowing the engine fuel system's pressure to drop. Prior to the complete loss of the engine fuel system's pressure the control valve 44 of the apparatus 10 is closed allowing the engine fuel system's pressure to return to the original setting. This on/off cycle using the control valve 44 of the apparatus 10 is repeated several times. Fuel and chemical mixture thereby pulsates through the engine fuel distribution system and dissolves the olefin and varnish contaminants, loosening the particles that have been held in the olefin and varnish contaminants and passing them through the return line 54 of the apparatus 10 into the reservoir 11 and subsequently filtered out by the high-volume cleaning solution filter 16 of the apparatus 10, thus ensuring that the particles do not flow back into the injector nozzle.
6. Upon completion of the flushing process time cycle, the technician releases the excess pressure of the fuel supply system of the engine to be cleaned by adjusting the pressure regulator 52 of the apparatus 10 to the engine manufacturer's specification using the pressure gauge 32 of the apparatus 10.
7. Same as Procedure "C".
8. Same as Procedure "A 7".
9. Same as Procedure "A 8".
10. Same as Procedure "A 9".

This concludes the description of a preferred embodiment of the present invention. Those skilled in the art may find many variations and adaptations falling within the scope of this invention, and the appended claims are intended to cover all such variations and adaptations falling within the true scope and spirit of the invention.

What is claimed is:

1. An apparatus for cleaning of carbon and other contaminants from a fuel distribution system and soft carbon and other contaminants from a combustion chamber of an internal combustion engine, wherein said engine includes a fuel pump, a fuel line, a fuel intake, and a return fuel line, wherein said apparatus operates at a pressure that defines an independent cleaning solution fuel system to temporarily replace an engine's fuel system, said apparatus comprising in combination:

a reservoir for holding cleaning solution therein;

means for pumping said cleaning solution from said reservoir into the fuel intake of the internal combustion engine, said means comprising:

a cleaning solution pump;

an output line connecting the cleaning solution pump and the fuel line of the engine at a point after the engine fuel pump to transport the cleaning solution to the fuel intake of the engine;

means for controlling said cleaning solution pump;

means connecting said apparatus to a power supply for said cleaning solution pumping means;

excess cleaning solution return means comprising:

a return line connecting the reservoir and the return fuel line of the engine to provide a conduit for returning excess cleaning solution from the engine to said reservoir; and an adjustable return pressure regulator means mounted to the return line to adjust the pressure of the apparatus to a pressure required to start the engine using the cleaning solution in said reservoir as fuel for the engine.

2. An apparatus as recited in claim 1, further comprising an adjustable output pressure regulator mounted between said cleaning solution pump and said output line.

3. An apparatus as recited in claim 2, further comprising a control valve mounted on a fluid line between said output pressure regulator and said adjustable return pressure regulator, wherein said adjustable return pressure regulator is operated when said control valve is in a closed position, and wherein said output regulator is operated when said control valve in an open position.

4. An apparatus as recited in claim 3, further comprising a first one-way valve to allow fluid flow from said return pressure regulator to be directed to said reservoir, said first one-way valve being mounted between said control valve and said return pressure regulator.

5. An apparatus as recited in claim 4, further comprising a second one-way valve mounted between said return line and said output line to prevent flow from said return line until a predetermined pressure is reached in said return line.

6. An apparatus as recited in claim 1 further comprising a pressure gauge to measure a pressure indicative of an internal pressure of the cleaning solution as pressurized by said cleaning solution pump within said apparatus and available within said output line.

7. An apparatus as recited in claim 1, further comprising a cleaning solution filter mounted between said reservoir and said cleaning solution pump.

8. An apparatus as recited in claim 7, further comprising a filter blockage detector mounted between said cleaning solution filter and said cleaning solution pump and a filter blockage indicator lamp connected to said filter blockage detector whereby under a condition of a blockage being detected, said filter blockage detector signals said blockage indicator lamp.

9. An apparatus as recited in claim 7, wherein said means for controlling said cleaning solution pump includes a control circuit.

10. An apparatus as recited in claim 9, wherein said control circuit includes:

a power supply on/off switch;

a timer switch in series with said power on/off switch, whereby a cycle of an operation of said apparatus is adjustably selected;

a cleaning solution filter pressure transducer mounted on said cleaning solution filter whereby a pressure in said cleaning solution filter is monitored relative to a preselected pressure threshold;

a blocked filter indicator connected to said cleaning solution filter transducer whereby said filter indicator is activated when the pressure as monitored by said filter transducer exceeds said preselected pressure threshold under a condition of the cleaning solution filter being blocked to prevent flow of cleaning solution therethrough; and a purge switch connected to said cleaning solution pump, whereby said cleaning solution pump is activated to pump said cleaning solution in reverse to return said cleaning solution back to said reservoir.

11. An apparatus as recited in claim 1, wherein said means for controlling said cleaning solution pump comprises:

a power supply on/off switch, and, a timer switch in series with said power on/off switch, whereby a cycle of an operation of said apparatus is adjustably selected.

12. An apparatus as recited in claim 11, said means for controlling said cleaning solution pump further comprising:

a pressure transducer connected to said output line and including a transducer switch connected to a relay interconnected between said on/off power switch and the cleaning solution pump, said relay having connections which have a first state of applying direct voltage to said cleaning solution pump to pump cleaning solution to said output line and a second state of applying reversed voltage to said cleaning solution pump, to reverse the pumping action of said cleaning solution pump to suck cleaning solution from said return line, said pressure transducer activated at a preselected pressure threshold to reverse power to said pump under a condition of said apparatus pressure being below said preselected pressure, and a start switch in parallel with said transducer switch to provide power to said cleaning solution pump from said power supply upon initiation of said cleaning solution pump at pressures below said preselected pressure threshold.

13. An apparatus as recited in claim 11, said means for controlling said cleaning solution pump further comprising:

a relay in series with said power on/off switch, said relay having connections which have a first state to supply direct voltage to said cleaning solution pump to pump cleaning solution into said output line and connections which have a second state to supply direct voltage to said pump in a polarity reversed from that of said first state to suck cleaning fluid from said output lines, and a purge switch to activate said relay from said first state to said second state.

14. An apparatus as recited in claim 1, wherein said apparatus includes a means to purge said output line of said cleaning solution, whereby said cleaning solution is returned to said reservoir.

15. An apparatus as recited in claim 1, further comprising a cart upon which said apparatus is mounted for transportation of said apparatus.

16. An apparatus as recited in claim 15 further comprising a self contained power supply means to supply power to said apparatus.

* * * * *